US009138120B2

(12) United States Patent
Hsu

(10) Patent No.: US 9,138,120 B2
(45) Date of Patent: Sep. 22, 2015

(54) AUTOMATIC FLOOR CLEANER

(71) Applicant: Yejen Appliances (Shenzhen) Limited, Shenzhen (CN)

(72) Inventor: Pei-Cheng Hsu, New Taipei (TW)

(73) Assignee: Yejen Appliances (Shenzhen) Ltd., Shenzhen (CN)

( * ) Notice: Subject to any disclaimer, the term of this patent is extended or adjusted under 35 U.S.C. 154(b) by 0 days.

(21) Appl. No.: 14/300,383

(22) Filed: Jun. 10, 2014

(65) Prior Publication Data

US 2014/0373302 A1 Dec. 25, 2014

(30) Foreign Application Priority Data

Jun. 19, 2013 (CN) ..... 2013 2 0351373 U

(51) Int. Cl.

| | |
|---|---|
| ***A47L 11/40*** | (2006.01) |
| ***A47L 9/28*** | (2006.01) |
| ***A47L 9/00*** | (2006.01) |
| ***A47L 9/06*** | (2006.01) |
| ***A47L 11/20*** | (2006.01) |

(52) U.S. Cl.

CPC ..... *A47L 11/4061* (2013.01); *A47L 9/009* (2013.01); *A47L 9/0606* (2013.01); *A47L 9/2852* (2013.01); *A47L 9/2857* (2013.01); *A47L 11/20* (2013.01); *A47L 2201/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,938,298 | B2 | 9/2005 | Aasen | |
| 7,246,405 | B2 * | 7/2007 | Yan | 15/340.1 |
| 7,320,149 | B1 * | 1/2008 | Huffman et al. | 15/320 |
| 7,346,428 | B1 * | 3/2008 | Huffman et al. | 700/245 |
| 2002/0011813 | A1 * | 1/2002 | Koselka et al. | 318/445 |
| 2010/0037421 | A1 * | 2/2010 | Haan | 15/383 |
| 2013/0232720 | A1 * | 9/2013 | Baek et al. | 15/340.1 |
| 2014/0131123 | A1 * | 5/2014 | Jang et al. | 180/21 |

* cited by examiner

*Primary Examiner* — Dung Van Nguyen

(74) *Attorney, Agent, or Firm* — Alan D. Kamrath; Kamrath IP Lawfirm, P.A.

(57) ABSTRACT

An automatic floor cleaner includes a cover, a base plate, a motive assembly, a driving wheel assembly, and a flat bottom plate. In use, the flat bottom plate can be attached with a dust removal sheet to mop a floor surface. When the floor cleaner hits an object, the driving wheel assembly can rotate about a vertical output axle of the motive assembly to cause the moving direction of the floor cleaner to be changed to a randomly new direction, so that the floor cleaner can escape the object to continue advancing and cleaning the floor surface. Furthermore, the floor cleaner can be mounted with a vacuum cleaning unit, so that the cleaning effect can be improved.

10 Claims, 9 Drawing Sheets

AUTOMATIC FLOOR CLEANER

BACKGROUND OF THE INVENTION

The present invention relates to a floor cleaner and, more particularly, to an automatic floor cleaner that can adjust its moving direction to continue the cleaning operation.

Dusts or particles are often existed on the floor in a house or a workplace. Generally, they are removed by a manual way, such as using broom or a vacuum cleaner. However, the manual way may increase the workload of the staff To reduce the workload, a mobile cleaning robot is disclosed in U.S. Pat. No. 6,938,298 B2, which employs a drive unit and a velcro system secured with a cleaning cloth to allow the robot to move across the floor in a random manner for removing dusts on the floor. Since the cloth is flexible, when the robot moves to a wall, the cloth can be moved a small distance up the wall, so that the dusts in the corner between the floor and the wall can be removed. Also, the robot can be provided with a fan to have it become a movable vacuum cleaner.

However, there are some drawbacks in the mobile cleaning robot as follows:

1. While cleaning the floor, the cloth may crease and thus the effect of removing dusts can be reduced.
2. It is difficult for the cloth to remove tiny dusts adhering to the floor.
3. Since the cleaning effect for the adjoining surface is determined by the amount of the cloth being moved up the surface, it is difficult for the adjoining surface to be cleaned evenly.

BRIEF SUMMARY OF THE INVENTION

Therefore, an objective of the present invention is to provide an automatic floor cleaner to improve the aforementioned shortcoming and deficiency of the prior art. The automatic floor cleaner of the present invention can have a flat contact with a floor surface so that it can be cleaned more effectively.

To achieve this and other objectives, an automatic floor cleaner of the present invention includes a cover, a base plate, a motive assembly, a driving wheel assembly, and a flat bottom plate. The cover is provided with an electrical switch on its top surface. The base plate, being affixed to the cover, defines a first bottom space near its front side, two second bottom spaces near two lateral sides thereof, and a flat bottom recess between the first bottom space and the second bottom spaces. The base plate is provided thereon with at least one hollow column that defines a central hole communicating with the flat bottom recess. A through-hole is defined in the base plate over the first bottom space. A rear wheel assembly is. mounted in each of the second bottom spaces. A power supply is provided on the base plate. The motive assembly, being mounted on the base plate, includes a motor and a vertical output axle. The electrical switch, the power supply, and the motor are electrically connected. The driving wheel assembly, being mounted in the first bottom space, includes an upper frame, a lower frame, and a driving gear therebetween. The lower frame is mounted with a horizontal axle provided with two wheels at two ends thereof and a driven gear coaxially therewith between the two wheels. The driving gear defines a hole in its center to be engaged with the vertical output axle of the motive assembly inserted through the through-hole of the first bottom space. The driving gear is in mesh with the driven gear. The flat bottom plate is provided with at least one vertical post on its top surface and velcro fasteners at its bottom surface. The vertical post is slidably fitted into the central hole of the hollow column, so that the flat bottom plate can slide downward by its weight. A piece of dust removal sheet can be attached to the bottom surface of the flat bottom plate through the velcro fasteners. When the floor cleaner hits an object, the driving wheel assembly can rotate about the vertical output axle to cause the moving direction of the floor cleaner to be changed to a randomly new direction, so that the floor cleaner can escape the object to continue advancing and cleaning the floor surface. Furthermore, the floor cleaner can be mounted with a vacuum cleaning unit in a bottom-mounting, top-mounting, or side-mounting manner to improve the cleaning effect.

The automatic floor cleaner of the present invention has the following effects:

1. In use, the flat bottom plate can slide downward by its weight, so that the cleaning sheet can contact the floor surface more definitely.
2. In use, the dust removal sheet can be in flat contact with the floor surface, so that the sheet will not crease.
3. In one embodiment of the, present invention, the vacuum cleaning unit can be mounted from a position below the base plate, and this allows the molds required for the cover and the base plate to be simplified.
4. In another embodiment of the present invention, the vacuum cleaning unit can be mounted from a position above the cover plate, and this allows the vacuum cleaning unit to be mounted or unmounted more easily, so that the dusts being collected in the unit can be dumped more easily.
5. In a further embodiment of the present invention, the vacuum cleaning unit can be mounted from a side position, and this allows the unit to have a better ventilation performance, thereby increasing the cleaning efficiency.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
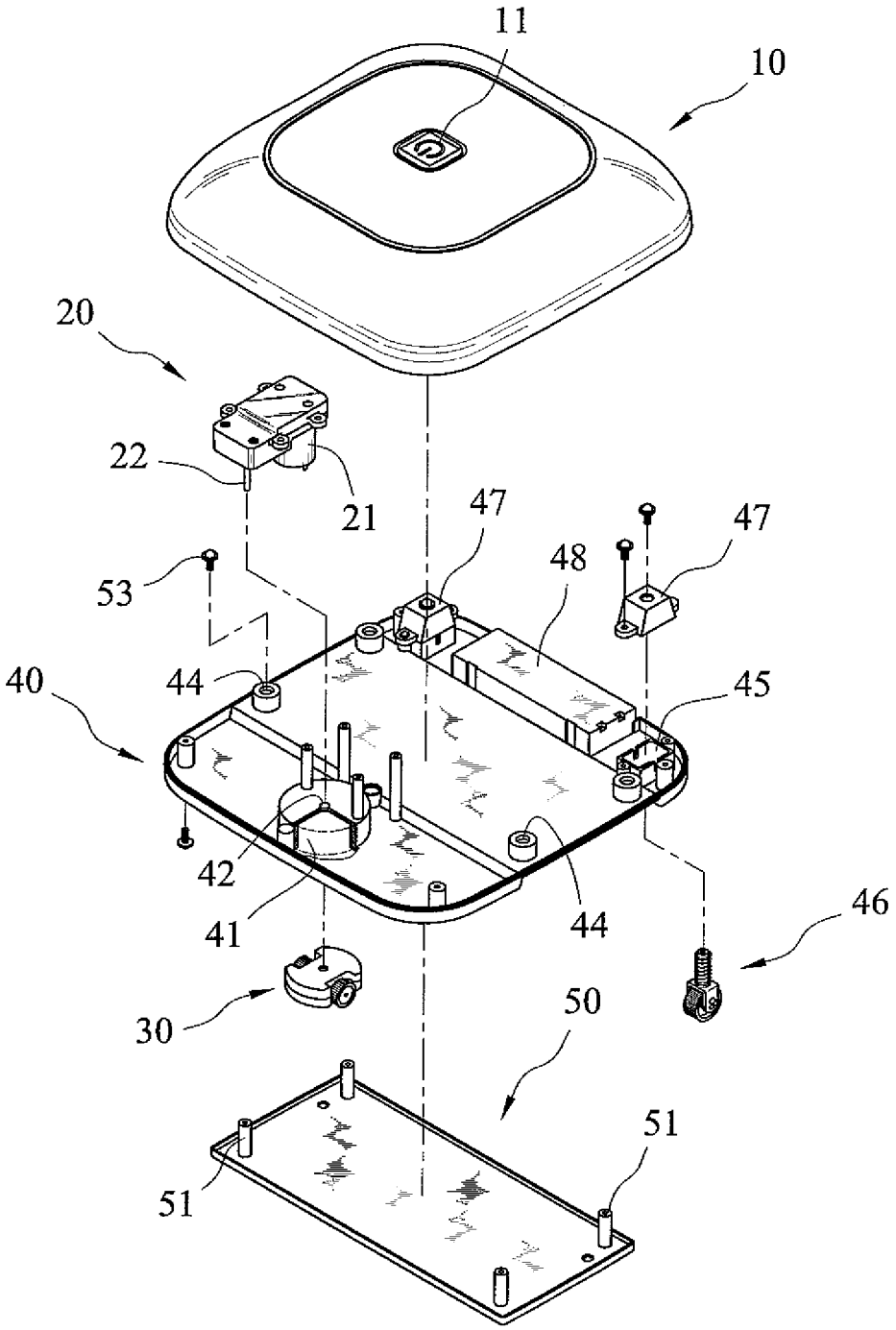
FIG. 1 shows an exploded view of an automatic floor cleaner of a first embodiment of the present invention.
Figure 2:
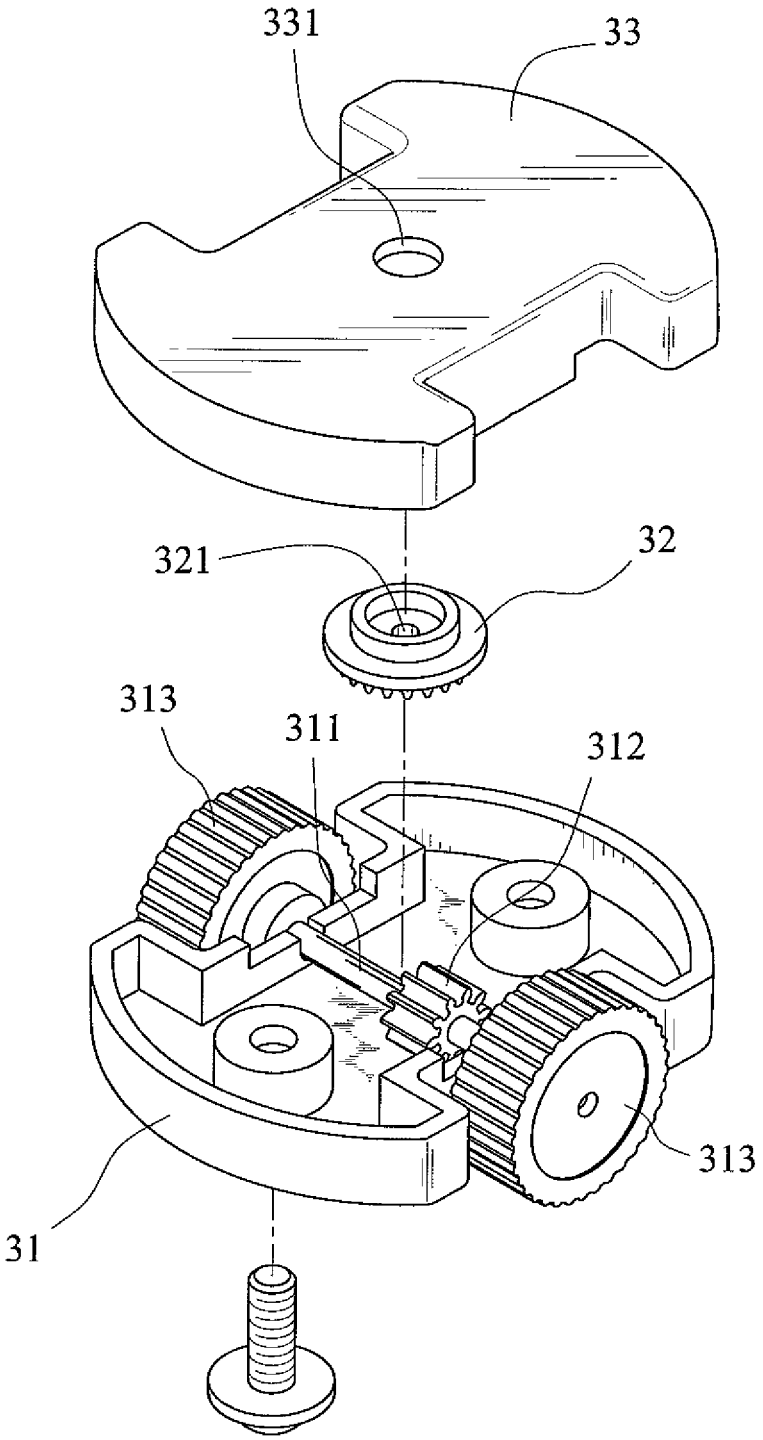
FIG. 2 shows an exploded view of a driving wheel assembly of the automatic floor cleaner of FIG. 1.
Figure 3:
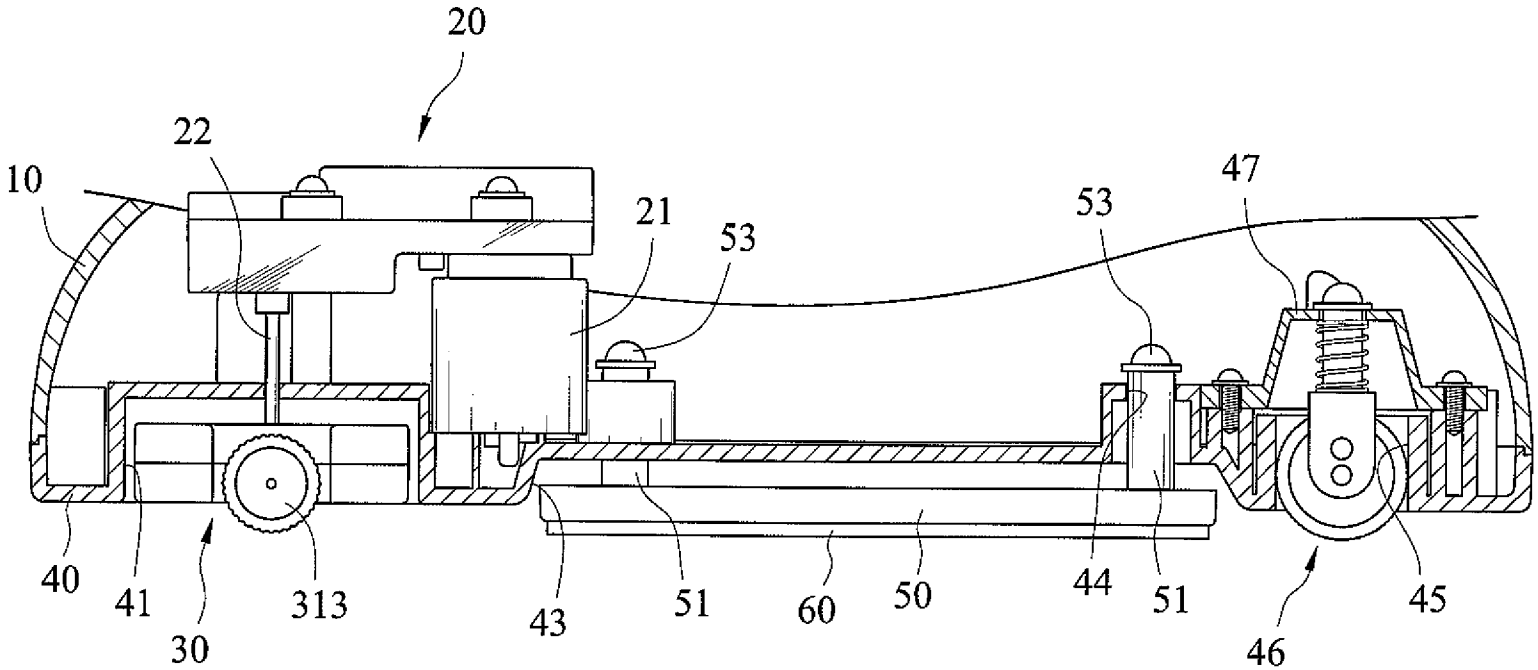
FIG. 3 shows a partially sectional view of the automatic floor cleaner of the present invention.
Figure 4:
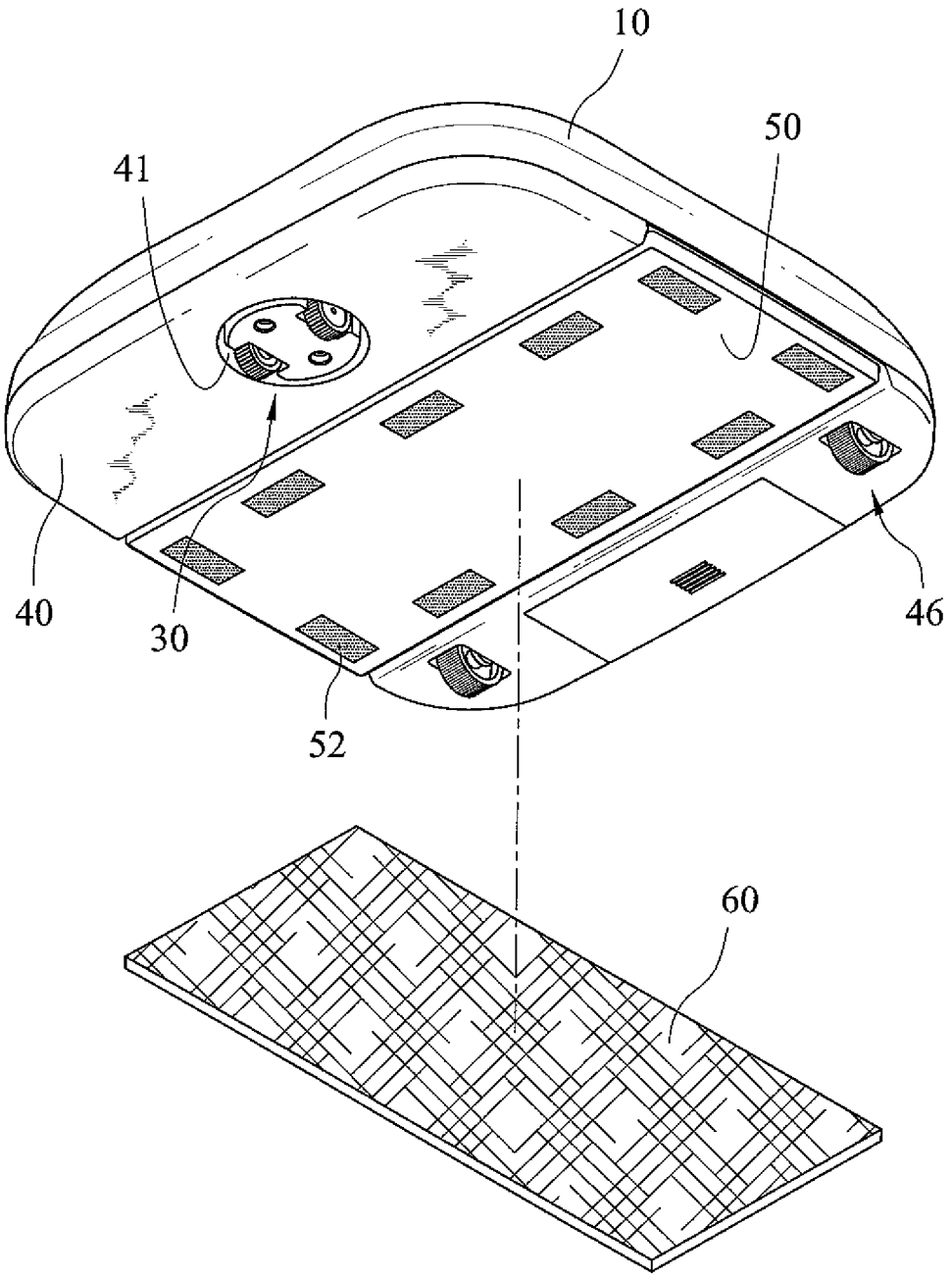
FIG. 4 shows a 3-dimensional view of a dust removal sheet and the first embodiment of the present invention.

Referring to FIGS. 1 through 4, an automatic floor cleaner according to a first embodiment of the present invention is shown, which generally includes a cover 10, a motive assembly 20, a driving wheel assembly 30, a base plate 40, and a flat bottom plate 50. The cover 10 can be affixed to the base plate 40 by using screws.

The cover 10, being generally rectangular in shape, is provided with an electrical switch 11 on its top surface for activating the floor cleaner to clean a floor surface. Other input devices can also be provided on the cover 10 for allowing a user to select the operation time. The base plate 40, being generally rectangular in shape, defines a first bottom space 41 near its front side. The first bottom space 41 is a recess for accommodating the driving wheel assembly 30. A through-hole 42 is defined in the base plate 40 over the first bottom space 41. There are two second bottom spaces 45 respectively defined near the right side and the left side of the base plate 40. The base plate 40 further defines a flat bottom recess 43 extending transversely in its bottom surface for accommodating the flat bottom plate 50. As shown, the flat bottom recess 43 is located between the first bottom space 41 and the two second bottom spaces 45. Also, there are four hollow columns 44 symmetrically provided on the base plate 40. Each hollow column 44 defines therein a central hole communicating with the flat bottom recess 43. A rear wheel assembly 46 can be mounted in each of the second bottom spaces 45. In this embodiment, each of the second bottom spaces 45 has a top open end. The rear wheel assembly 46 is mounted in the corresponding second bottom space 45 by a wheel cap 47 over the corresponding second bottom space 45. The wheel cap 47 is fixed to the rear wheel assembly 46 and the base plate 40 by screws. A power supply 48 is provided on the base plate 40 between the two wheel caps 47.

The motive assembly 20 is mounted on the base plate 40 at a location above the first bottom space 41. The motive assembly 20 includes a motor 21 and a vertical output axle 22. The electrical switch 11, the power supply 48, and the motor 21 are electrically connected.

The driving wheel assembly 30, which is mounted in the first bottom space 41, includes an upper frame 33, a lower frame 31, and a driving gear 32 therebetween. The upper frame 33 defines a through-hole 331. The upper frame 33 can be affixed to the lower frame 31 by using screws to form a housing that can accommodate the horizontal axle 311, the driven gear 312, and the driving gear 32. The lower frame 31 is mounted with the horizontal axle 311 provided with two wheels 313 at two ends thereof and the driven gear 312 coaxially therewith between the two wheels 313. The driving gear 32 defines a hole 321 in its center to be engaged with the vertical output axle 22 of the motive assembly 20 being inserted through the through-hole 42 of the first bottom space 41 and the through-hole 331 of the upper frame 33. The driving gear 32 is in mesh with the driven gear 312. As such, the motor 21 can drive the vertical output axle 22 together with the driving gear 32 to rotate, for example, by a gearset in the motive assembly 20, which can cause the driven gear 312 and the horizontal axle 311 and the wheels 313 to rotate together, so that the floor cleaner can advance along a floor surface. When the floor cleaner hits an object, such as a wall, a piece of furniture, etc., the driving wheel assembly 30 can rotate about the vertical output axle 22 within the first bottom space 41, and thus the moving direction of the floor cleaner can be changed to a randomly new direction to escape the object, and thus the floor cleaner can advance again.

The flat bottom plate 50, being rectangular in shape, is provided with four vertical posts 51, corresponding to the hollow columns 44, on its top surface and a plurality of velcro fasteners 52 at its bottom surface for attaching a dust removal sheet 60, such as a mopping paper or a mopping cloth. As shown, each vertical post 51 of the flat bottom plate 50 has a length greater than the height of the corresponding hollow column 44. Each vertical post 51 is slidably inserted into the central hole of the corresponding hollow column 44 and is provided with a stop 53 at its end, such as a screw, to prevent the flat bottom plate 50 from falling off the columns.

In operation, a dust removal sheet 60 can be attached to the flat bottom plate 50 through the velcro fasteners 52. Thereafter, the electrical switch 11 can be switched on. The operation time can also be set for the operation, so that the floor cleaner can be stopped automatically when the operation time elapses. Thereafter, the floor cleaner can be placed on a floor surface. Since the flat bottom plate 50 can slide downward by its weight, the dust removal sheet 60 can be in flat contact with the floor surface. As such, the dust removal sheet 60 can contact the floor surface more definitely without creases, so that the dusts on the floor can be removed more effectively. When the floor cleaner hits an object, the driving wheel assembly 30 can rotate about the vertical output axle 22 to cause the moving direction of the floor cleaner to be changed to a randomly new direction, thereby escaping the object. Thereafter, the floor cleaner can continue advancing and cleaning until the operation time elapses.

Figure 5:
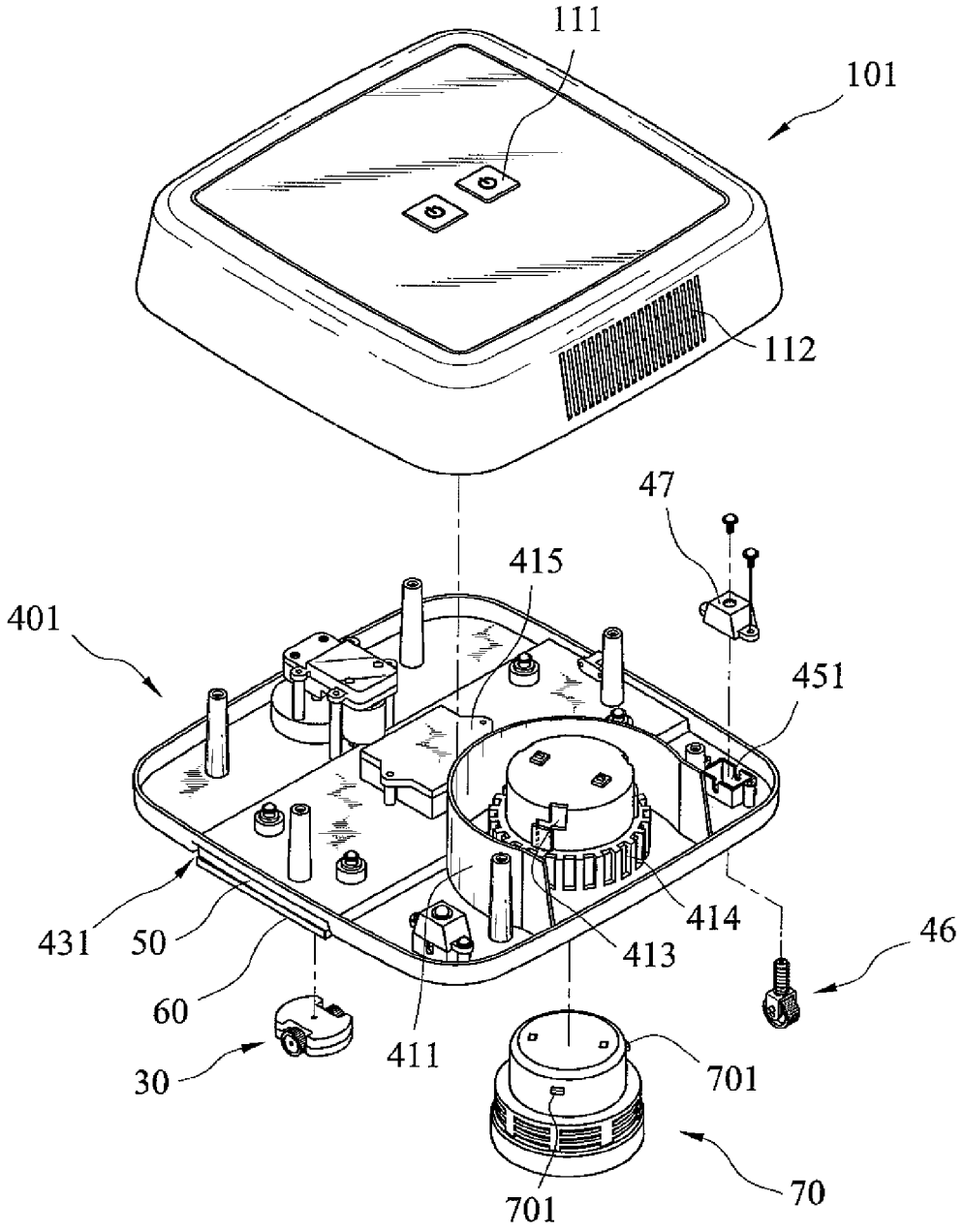
FIG. 5 shows an exploded view of an automatic floor cleaner of a second embodiment of the present invention.
Figure 6:
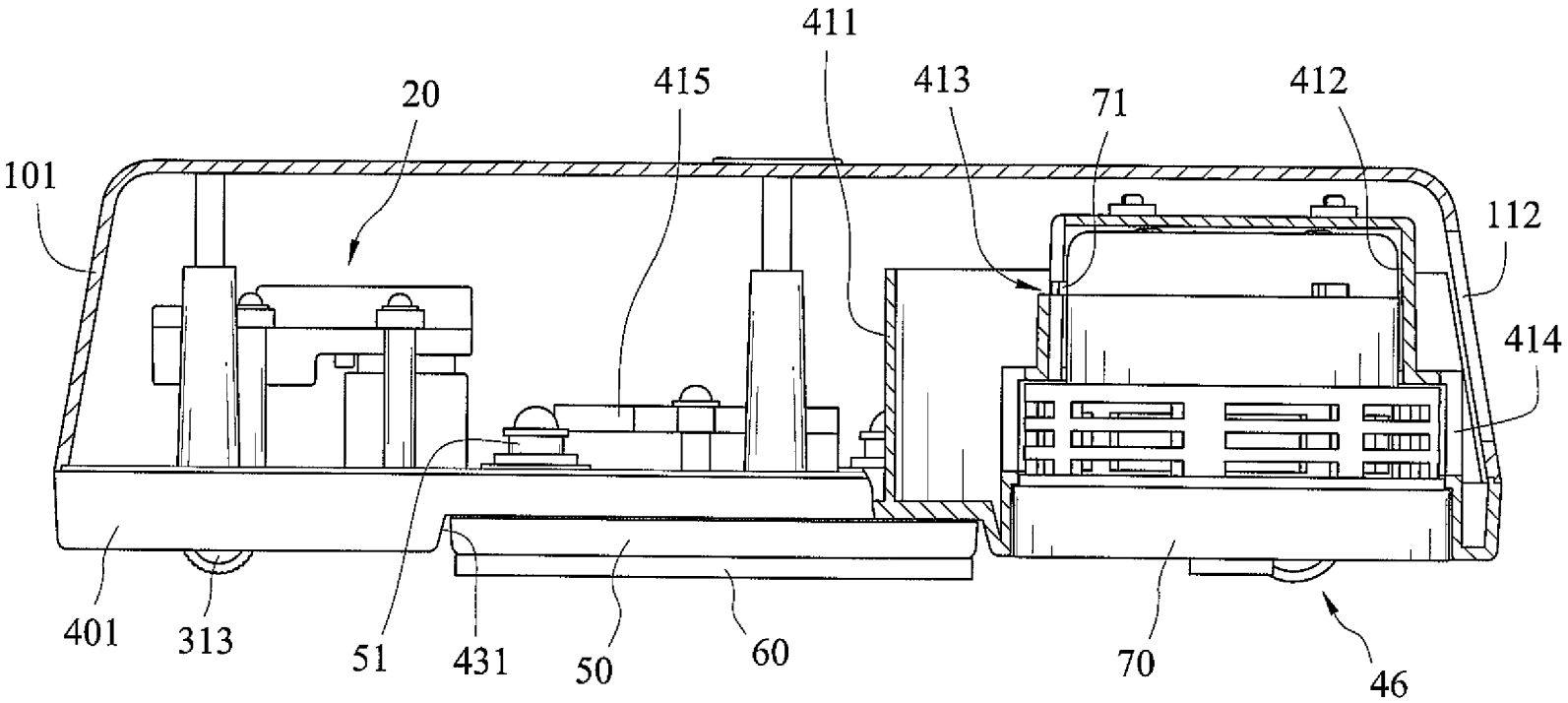
FIG. 6 shows a sectional view of the second embodiment of the present invention.

FIGS. 5 and 6 show a second embodiment of the present invention. As shown, in addition to the cover 101, the base 401, the flat bottom plate 50, the dust removal sheet 60, the wheel caps 47, and the rear wheel assemblies 46, the floor cleaner further includes a vacuum cleaning unit 70, which defines outtakes around its periphery and intakes in its bottom. Also, the vacuum cleaning unit 70 is provided with an engagement lug 71 at its periphery. The cover 101 is provided with an electrical switch 111 on its top surface. Furthermore, the cover 101 defines outlet ventilation openings 112 in one side thereof. The power supply 415 is provided on the base plate 401 above the flat bottom recess 431. The base plate 401 has an enclosed inner wall defining a third bottom space 412, being a recess, between the second bottom spaces 451 and defines inlet ventilation openings 414 around the enclosed inner wall and defines an attachment slot 413 in the enclosed inner wall. Furthermore, the base plate 401 is provided with a separation wall 411 extending from a rear side of the base plate 401 and going around the enclosed inner wall and coming back to the rear side of the base plate 401. The vacuum cleaning unit 70 is detachably mounted into the third bottom space 412 from a lower position through engagement between the attachment lug 71 and the attachment slot 413, so that the inlet ventilation openings 414 of the base plate 401 face and communicate with the outtakes of the vacuum cleaning unit 70, and the separation wall 411 guides the air flowing from the inlet ventilation openings 414 of the base plate 401 to the outlet ventilation openings 112 of the cover 101. Furthermore, the vacuum cleaning unit 70 can be provided with two electrical contacts on its top while the base plate 401 can be provided with corresponding electrical contacts within the third bottom space 412. When the vacuum cleaning unit 70 is mounted into the third bottom space 412, the two sets of electrical contacts can be connected, so that the vacuum cleaning unit 70 can be electrically connected with the power supply 415 and the electrical switch 111. With the vacuum cleaning unit 70, tiny dusts can be removed away from the floor surface more effectively. Furthermore, this embodiment allows the molds required for the cover 101 and the base plate 401 to be simplified.

Figure 7:
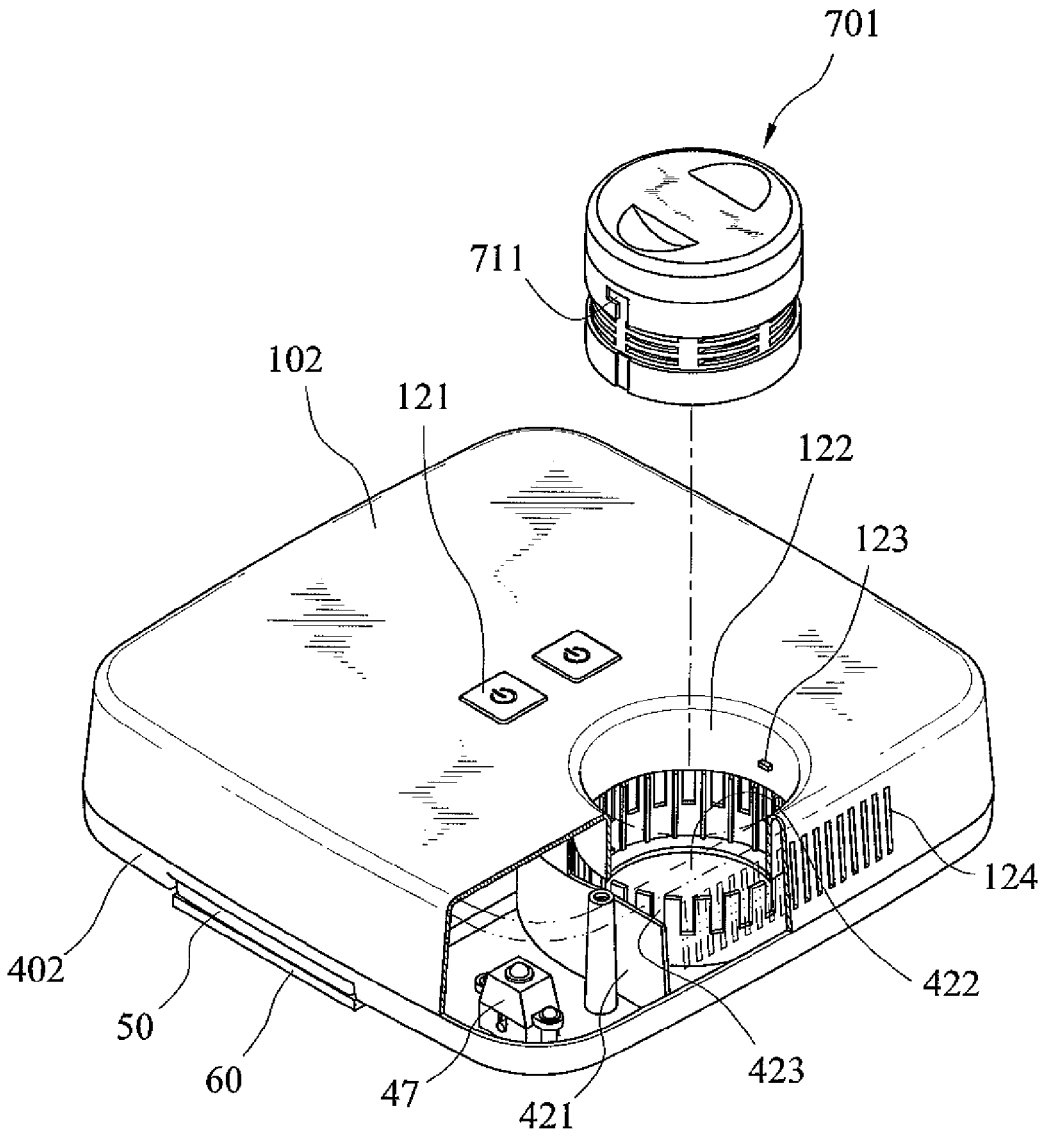
FIG. 7 shows a partially exploded view of an automatic floor cleaner of a third embodiment of the present invention.

FIG. 7 shows a third embodiment of the present invention, which is different from the second embodiment in mounting the vacuum cleaning unit. The vacuum cleaning unit 701 defines outtakes around its periphery, intakes in its bottom, and an attachment groove 711 at its periphery. The base plate 402 has an enclosed inner wall defining a third bottom space 422, being a through opening. Also, the base 402 defines inlet ventilation openings 423 around the enclosed inner wall. The base plate 402 is provided with a separation wall 421 extending from a rear side of the base plate 402 and going around the enclosed inner wall and coming back to the rear side of the base plate 402. The cover 102 has an enclosed inner wall that defines a top space 122, being a through opening, corresponding to the third bottom space 422. Also, the cover 102 defines outlet ventilation openings 124 in one side thereof corresponding to the inlet ventilation openings 423 of the base plate 402 and is provided with an attachment lug 123 at the enclosed inner wall of the cover 102. The vacuum cleaning unit 701 is detachably mounted into the top space 122 and the third bottom space 422 from a higher position through engagement between the attachment lug 123 and the attachment groove 711, so that the inlet ventilation openings 423 of the base plate 402 face and communicate with the outtakes of the vacuum cleaning unit 701, and the separation wall 421 guides the air flowing from the inlet ventilation openings 423 of the base plate 402 to the outlet ventilation openings 124 of the cover 102. Furthermore, the vacuum cleaning unit 701 can be provided with two electrical contacts on its periphery while the cover 102 or the base plate 402 can be provided with corresponding electrical contacts. This allows the vacuum cleaning unit 701 to be electrically connected with the power supply and the electrical switch. This embodiment can facilitate the mounting or unmounting of the vacuum cleaning unit 701, so that the dusts being collected in the vacuum cleaning unit 701 can be dumped more easily.

Figure 8:
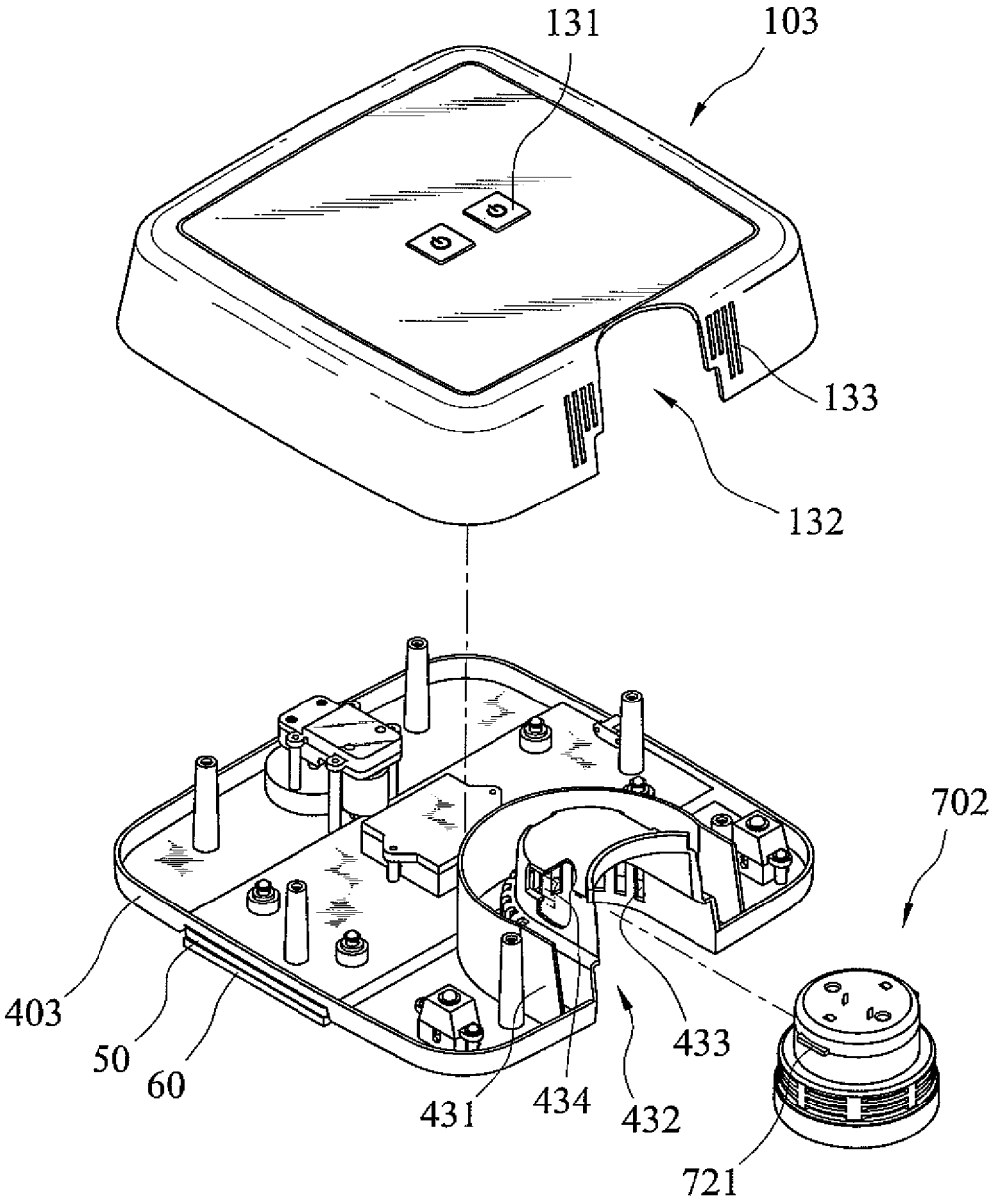
FIG. 8 shows an exploded view of an automatic floor cleaner of a fourth embodiment of the present invention.
Figure 9:
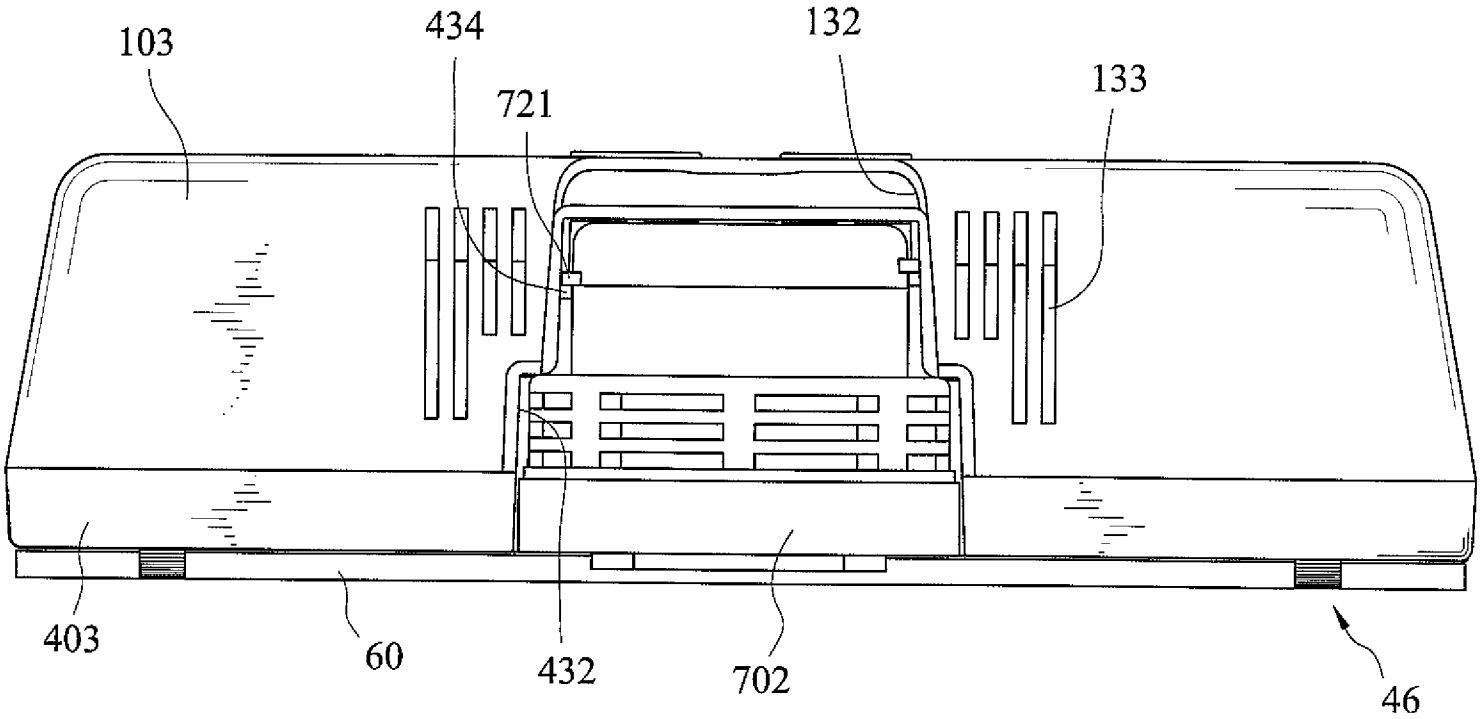
FIG. 9 shows a sectional view of the fourth embodiment of the present invention.

FIGS. 8 and 9 show a fourth embodiment of the present invention, which is different from the previous embodiments in installing the vacuum cleaning unit. The vacuum cleaning unit 702 defines outtakes around its periphery and intakes at its bottom. Also, the vacuum cleaning unit 702 is provided with an attachment lug 721 at its periphery. The base plate 403 has an inwardly extending wall at a rear side thereof defining a third bottom space 432 with a side opening and defines inlet ventilation openings 433 around the inwardly extending wall and defines an attachment slot 434 in the inwardly extend wall. The base plate 403 is provided with a separation wall 431 around the inwardly extending wall. The cover 103 defines an entrance opening 132 corresponding to the side opening of the third bottom space 432 and defines outlet ventilation openings 133 being adjacent to the entrance opening 132 and corresponding to the inlet ventilation openings 433 of the base plate 403. The vacuum cleaning unit 702 is detachably mounted into the third bottom space 432 via the entrance opening 132 through engagement between the attachment lug 721 and the attachment slot 434, so that the inlet ventilation openings 433 of the base plate 403 face and communicate with some of the outtakes of the vacuum cleaning unit 702, and the separation wall 431 guides the air flowing from the inlet ventilation openings 433 of the base plate 402 to the outlet ventilation openings 133 of the cover 103. Furthermore, the vacuum cleaning unit 702 can be provided with two electrical contacts on its top while the cover 103 can be provided with corresponding electrical contacts. This allows the vacuum cleaning unit 702 to be electrically connected with the power supply and the electrical switch. This embodiment has a better ventilation performance and thus can increase the cleaning efficiency.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. An automatic floor cleaner comprising:

a cover provided with an electrical switch on its top surface;

a base plate affixed to the cover, with the base plate defining a first bottom space near its front side, two second bottom spaces near two lateral sides thereof, and a flat bottom recess between the first bottom space and the second bottom spaces, with the base plate provided thereon with at least one hollow column that defines a central hole communicating with the flat bottom recess, with a through-hole defined in the base plate over the first bottom space, with a rear wheel assembly mounted in each of the second bottom spaces, with a power supply provided on the base plate;

a motive assembly mounted on the base plate, with the motive assembly including a motor and a vertical output axle, wherein the electrical switch, the power supply, and the motor are electrically connected;

a driving wheel assembly mounted in the first bottom space, with the driving wheel assembly including an upper frame, a lower frame, and a driving gear therebetween, with the lower frame mounted with a horizontal axle provided with two wheels at two ends thereof and a driven gear coaxially therewith between the two wheels, with the driving gear defining a hole in its center to be engaged with the vertical output axle of the motive assembly inserted through the through-hole of the first bottom space, with the driving gear being in mesh with the driven gear, wherein the driving wheel assembly is able to rotate about the vertical output axle when hitting a blocking object; and a flat bottom plate provided with at least one vertical post on its top surface and velcro fasteners at its bottom surface, with the at least one vertical post slidably fitted into the central hole of the hollow column, wherein the flat bottom plate will slide downward by its weight.

2. The automatic floor cleaner of claim 1, wherein each of the second bottom spaces has a top open end, and a rear wheel assembly is mounted in the corresponding bottom space by a wheel cap over the corresponding bottom space, wherein the wheel cap is fixed to the rear wheel assembly and the base plate.

3. The automatic floor cleaner of claim 1, wherein a dust removal sheet is attached to the bottom surface of the flat bottom plate through the velcro fasteners.

4. The automatic floor cleaner of claim 3, wherein the vertical post of the flat bottom plate has a length greater than the height of the hollow column, with the vertical post provided with a screw at its top end after it is inserted through the hollow column.

5. The automatic floor cleaner of claim 1, further comprising:

a vacuum cleaning unit defining outtakes around its periphery and provided with an attachment lug at its periphery, wherein the base plate has an enclosed inner wall defining a third bottom space and defines inlet ventilation openings around the enclosed inner wall and defines an attachment slot in the enclosed inner wall, the base is provided with a separation wall around the enclosed inner wall, and the cover defines outlet ventilation openings in one side thereof corresponding to the Inlet ventilation opening of the base plate, wherein the vacuum cleaning unit is detachably mounted into the third bottom space from a lower position through engagement between the attachment lug and the attachment slot, wherein the inlet ventilation openings of the base plate face and communicate with the outtakes of the vacuum cleaning unit, and the separation wall guides the air flowing from the inlet ventilation openings of the base plate to the outlet ventilation openings of the cover.

6. The automatic floor cleaner of claim 5, wherein the vacuum cleaning unit is electrically connected with the power supply and the electrical switch.

7. The automatic floor cleaner of claim 1, further comprising:

a vacuum cleaning unit defining outtakes around its periphery and an attachment groove in its periphery, wherein the base plate has an enclosed inner wall defining a third bottom space and defines inlet ventilation openings around the enclosed inner wall and is provided with a separation wall around the enclosed inner wall, and the cover has an enclosed inner wall defining a top space corresponding to the third bottom space and defines outlet ventilation openings in one side thereof corresponding to the inlet ventilation openings of the base plate and is provided with an attachment lug at the enclosed inner wall of the cover, wherein the vacuum cleaning unit is detachably mounted into the top space and the third bottom space from a higher position through engagement between the attachment lug and the attachment groove, wherein the inlet ventilation openings of the base plate face and communicate with the outtakes of the vacuum cleaning unit, and the separation wall guides the air flowing from the inlet ventilation openings of the base plate to the outlet ventilation openings of the cover.

8. The automatic floor cleaner of claim 7, wherein the vacuum cleaning unit is electrically connected with the power supply and the electrical switch.

9. The automatic floor cleaner of claim 1, further comprising:

a vacuum cleaning unit defining outtakes around its periphery and provided with an attachment lug at its periphery, wherein the base plate has an inwardly extending wall, at a rear side thereof, defining a third bottom space with a side opening, the base plates defines inlet ventilation openings around the inwardly extending wall and defines an attachment slot in the inwardly extending wall and is provided with a separation wall around the inwardly extending wall, and the cover defines an entrance opening corresponding to the side opening of the third bottom space and defines outlet ventilation openings being adjacent to the entrance opening and corresponding to the inlet ventilation openings of the base plate, wherein the vacuum cleaning unit is detachably mounted into the third bottom space via the entrance opening through engagement between the attachment lug and the attachment slot, wherein the inlet ventilation openings of the base plate face and communicate with some of the outtakes of the vacuum cleaning unit, and the separation wall guides the air flowing from the inlet ventilation openings of the base plate to the outlet ventilation openings of the cover.

10. The automatic floor cleaner of claim 9, wherein the vacuum cleaning unit is electrically connected with the power supply and the electrical switch.

* * * * *